US009393478B2

(12) United States Patent
Niegowski

(10) Patent No.: US 9,393,478 B2
(45) Date of Patent: Jul. 19, 2016

(54) SYSTEM AND METHOD FOR TRACKING ONE OR MORE ROUNDS OF GOLF

(75) Inventor: James A. Niegowski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 859 days.

(21) Appl. No.: 12/034,626

(22) Filed: Feb. 20, 2008

(65) Prior Publication Data

US 2009/0209358 A1 Aug. 20, 2009

(51) Int. Cl.

| | |
|---|---|
| ***G06F 19/00*** | (2011.01) |
| ***A63B 71/06*** | (2006.01) |
| ***A43B 3/00*** | (2006.01) |
| ***A43B 5/16*** | (2006.01) |
| ***A63B 24/00*** | (2006.01) |

(Continued)

(52) U.S. Cl.

CPC ..... *A63B 71/0622* (2013.01); *A43B 3/0005* (2013.01); *A43B 5/16* (2013.01); *A63B 24/00* (2013.01); *A63B 24/0021* (2013.01); *A63B 71/0669* (2013.01); *A63B 55/00* (2013.01); *A63B 71/0616* (2013.01); *A63B 2024/0025* (2013.01); *A63B 2024/0056* (2013.01); *A63B 2069/362* (2013.01); *A63B 2071/0647* (2013.01); *A63B 2071/0691* (2013.01); *A63B 2102/32* (2015.10); *A63B 2220/12* (2013.01); *A63B 2220/13* (2013.01); *A63B 2220/14* (2013.01); *A63B 2220/16* (2013.01); *A63B 2220/20* (2013.01); *A63B 2220/30* (2013.01); *A63B 2220/40* (2013.01); *A63B 2220/51* (2013.01); *A63B 2220/53* (2013.01); *A63B 2220/80* (2013.01); *A63B 2220/801* (2013.01); *A63B 2220/803* (2013.01); *A63B 2220/833* (2013.01); *A63B 2220/836* (2013.01); *A63B 2225/15* (2013.01); *A63B 2225/20* (2013.01); *A63B 2225/50* (2013.01); *A63B 2225/54* (2013.01)

(58) Field of Classification Search

USPC ..... 463/40; 473/407, 283, 409

See application file for complete search history.

(56) References Cited

U.S. PATENT DOCUMENTS

| | | | |
|---|---|---|---|
| 3,753,564 | A | 8/1973 | Brandell |
| 3,829,102 | A | 8/1974 | Harrison |

(Continued)

FOREIGN PATENT DOCUMENTS

| | | |
|---|---|---|
| KR | 10-2010-0095917 | 10/2010 |
| WO | 9965574 A2 | 12/1999 |

(Continued)

OTHER PUBLICATIONS http://www.sureshotgps.com/sureshotgps.php, Feb. 7, 2007.

(Continued)

*Primary Examiner* — Paul A D'Agostino
*Assistant Examiner* — Brandon Gray
(74) *Attorney, Agent, or Firm* — Banner & Witcoff, Ltd.

(57) ABSTRACT

Systems and methods for tracking rounds of golf include a tracking system to track a golfer's position on a golf course and a golf stroke information providing system for providing information about a golf stroke taken by the golfer. The systems and methods also may include a coordinating system to coordinate the information about the golf stroke with the information about the golfer's tracked position on the golf course. The systems and methods also may include a recording system to record and store information about a golf stroke taken and the information about the golfer's tracked position on the golf course. The recorded and saved data may be displayed and/or otherwise analyzed and processed.

38 Claims, 12 Drawing Sheets

(51) Int. Cl.
*A63B 55/00* (2015.01)
*A63B 69/36* (2006.01)

(56) References Cited

U.S. PATENT DOCUMENTS

| | | | | |
|---|---|---|---|---|
| 3,931,363 | A | 1/1976 | Giolito et al. | |
| 3,931,969 | A | 1/1976 | Townhill | |
| 3,979,125 | A | 9/1976 | Lancellotti | |
| 4,291,883 | A | 9/1981 | Smart et al. | |
| 4,898,389 | A | 2/1990 | Plutt | |
| 4,940,236 | A | 7/1990 | Allen | |
| 5,160,142 | A | 11/1992 | Marshall | |
| 5,230,512 | A | 7/1993 | Tattershall | |
| 5,245,537 | A | 9/1993 | Barber | |
| 5,354,063 | A | 10/1994 | Curchod | |
| 5,364,093 | A | 11/1994 | Huston et al. | |
| 5,372,365 | A | 12/1994 | McTeigue et al. | |
| 5,413,345 | A | 5/1995 | Nauck | |
| 5,441,269 | A | 8/1995 | Henwood | |
| 5,524,081 | A | 6/1996 | Paul | |
| 5,634,855 | A | 6/1997 | King | |
| 5,718,301 | A | 2/1998 | Williams | |
| 5,779,555 | A | 7/1998 | Nomura et al. | |
| 5,792,001 | A | 8/1998 | Henwood | |
| 5,973,596 | A * | 10/1999 | French et al. | 340/568.6 |
| 6,248,021 | B1 | 6/2001 | Ognjanovic | |
| 6,386,987 | B1 | 5/2002 | Lejeune, Jr. | |
| 6,456,938 | B1 | 9/2002 | Barnard | |
| 6,558,268 | B2 | 5/2003 | Tindale | |
| 6,575,854 | B1 | 6/2003 | Yang et al. | |
| 6,697,820 | B1 | 2/2004 | Tarlie | |
| 6,757,572 | B1 | 6/2004 | Forest | |
| 6,802,772 | B1 | 10/2004 | Kunzle et al. | |
| 6,900,759 | B1 | 5/2005 | Katayama | |
| 6,923,729 | B2 * | 8/2005 | McGinty et al. | 473/222 |
| 7,004,848 | B2 | 2/2006 | Konow | |
| 7,021,140 | B2 | 4/2006 | Perkins | |
| 7,037,198 | B2 | 5/2006 | Hameen-Anttila | |
| 7,077,757 | B1 | 7/2006 | Payne et al. | |
| 7,118,498 | B2 * | 10/2006 | Meadows et al. | 473/407 |
| 7,121,962 | B2 | 10/2006 | Reeves | |
| 7,160,200 | B2 | 1/2007 | Grober | |
| 7,166,041 | B2 | 1/2007 | Evans | |
| 7,175,177 | B2 | 2/2007 | Meifu et al. | |
| 7,214,138 | B1 | 5/2007 | Stivers et al. | |
| 7,234,351 | B2 | 6/2007 | Perkins | |
| 7,235,020 | B1 | 6/2007 | Christensen | |
| 7,310,895 | B2 | 12/2007 | Whittlesey et al. | |
| 7,335,112 | B1 | 2/2008 | Bitondo | |
| 7,371,184 | B2 | 5/2008 | Tao | |
| 7,881,499 | B2 | 2/2011 | Bissonnette et al. | |
| 8,342,978 | B2 | 1/2013 | Tamura | |
| 2001/0035880 | A1 | 11/2001 | Musatov et al. | |
| 2002/0004723 | A1 | 1/2002 | Meifu et al. | |
| 2002/0019677 | A1 | 2/2002 | Lee | |
| 2002/0049507 | A1 * | 4/2002 | Hameen-Anttila | 700/92 |
| 2002/0052750 | A1 | 5/2002 | Hirooka | |
| 2002/0072815 | A1 | 6/2002 | McDonough et al. | |
| 2002/0082775 | A1 | 6/2002 | Meadows et al. | |
| 2002/0151994 | A1 | 10/2002 | Sisco | |
| 2002/0173364 | A1 | 11/2002 | Boscha | |
| 2003/0008722 | A1 | 1/2003 | Konow | |
| 2003/0014134 | A1 | 1/2003 | Morgan | |
| 2003/0054900 | A1 | 3/2003 | Tindale | |
| 2003/0132844 | A1 * | 7/2003 | Walker | 340/568.6 |
| 2003/0191547 | A1 | 10/2003 | Morse | |
| 2004/0067797 | A1 | 4/2004 | Knecht | |
| 2004/0229707 | A1 | 11/2004 | Lin | |
| 2005/0043109 | A1 | 2/2005 | Buckley et al. | |
| 2005/0054457 | A1 | 3/2005 | Eyestone et al. | |
| 2005/0096761 | A1 | 5/2005 | Hanover, Jr. et al. | |
| 2005/0215340 | A1 | 9/2005 | Stites et al. | |
| 2005/0282650 | A1 | 12/2005 | Miettinen et al. | |
| 2006/0040757 | A1 | 2/2006 | Rosselli | |
| 2006/0063600 | A1 | 3/2006 | Grober | |
| 2006/0089845 | A1 | 4/2006 | Marcell et al. | |
| 2006/0105853 | A1 | 5/2006 | Glass | |
| 2006/0109116 | A1 * | 5/2006 | Keays | 340/568.6 |
| 2006/0122002 | A1 | 6/2006 | Konow | |
| 2006/0194178 | A1 | 8/2006 | Goldstein | |
| 2006/0199659 | A1 | 9/2006 | Caldwell | |
| 2006/0240908 | A1 | 10/2006 | Adams et al. | |
| 2006/0276256 | A1 * | 12/2006 | Storek | 473/221 |
| 2007/0006489 | A1 | 1/2007 | Case, Jr. et al. | |
| 2007/0087866 | A1 | 4/2007 | Meadows et al. | |
| 2007/0111811 | A1 | 5/2007 | Grober | |
| 2007/0129178 | A1 | 6/2007 | Reeves | |
| 2007/0135225 | A1 | 6/2007 | Nieminen et al. | |
| 2007/0135237 | A1 | 6/2007 | Reeves | |
| 2007/0191126 | A1 * | 8/2007 | Mandracken | 473/131 |
| 2007/0270214 | A1 | 11/2007 | Bentley | |
| 2008/0039222 | A1 | 2/2008 | Kiraly | |
| 2008/0085778 | A1 | 4/2008 | Dugan | |
| 2008/0085788 | A1 | 4/2008 | Rainer et al. | |
| 2008/0318703 | A1 | 12/2008 | Mooney | |
| 2009/0111602 | A1 * | 4/2009 | Savarese et al. | 473/283 |
| 2009/0118035 | A1 | 5/2009 | Roenick | |
| 2009/0203462 | A1 | 8/2009 | Stites et al. | |
| 2009/0209358 | A1 | 8/2009 | Niegowski | |
| 2009/0260426 | A1 | 10/2009 | Lieberman et al. | |
| 2010/0063778 | A1 | 3/2010 | Schrock et al. | |
| 2010/0063779 | A1 | 3/2010 | Schrock et al. | |
| 2010/0099509 | A1 | 4/2010 | Ahem et al. | |
| 2010/0144456 | A1 | 6/2010 | Ahern | |
| 2010/0154255 | A1 | 6/2010 | Robinson et al. | |
| 2011/0207552 | A1 | 8/2011 | Finn et al. | |
| 2011/0230273 | A1 | 9/2011 | Niegowski et al. | |

FOREIGN PATENT DOCUMENTS

| | | | |
|---|---|---|---|
| WO | 2004071594 | A1 | 8/2004 |
| WO | 2006/014459 | A2 | 2/2006 |
| WO | 2008154684 | A1 | 12/2008 |
| WO | 2009/152456 | A2 | 12/2009 |
| WO | 2012/138543 | A2 | 10/2012 |

OTHER PUBLICATIONS http://www.sureshotgps.com/faq.php, Feb. 7, 2007.

Surehshot GPS advertisment.

International Search Report and Written Opinion from PCT/US2012/031233 mailed Jan. 30, 2013.

International Search Report and Written Opinion from PCT/US2012/031844 mailed Jan. 30, 2013.

ISR and WO from PCT Application No. PCT/US2012/031131 mailed Sep. 5, 2012.

United States Patent and Trademark Office, "Non-Final Office Action," issued in connection with U.S. Appl. No. 13/079,959, issued Aug. 9, 2013, 14 pages.

Office Action issued Apr. 15, 2013 in related U.S. Appl. No. 13/079,959.

Office Action issued Mar. 25, 2013 in related U.S. Appl. No. 13/080,011.

Office Action issued Oct. 24, 2012 in related U.S. Appl. No. 13/079,949.

Office Action issued Oct. 24, 2012 in related U.S. Appl. No. 13/079,959.

Office Action issued Aug. 29, 2012 in related U.S. Appl. No. 13/080,011.

ISR and WO from PCT/US2012/031101 mailed Jan. 2, 2013.

Partial ISR from PCT/US2012/031844 mailed Aug. 2, 2012.

Office Action issued Oct. 12, 2012 in related U.S. Appl. No. 13/079,984.

ISR from PCT/US2012/031233 mailed Aug. 2, 2012.

(56) References Cited

OTHER PUBLICATIONS

International Bureau, "International Preliminary Report on Patentability," issued in connection with international application serial No. PCT/US2012/031101, mailed Oct. 17, 2013, 12 pages.

International Bureau, "International Preliminary Report on Patentability," issued in connection with international application serial No. PCT/US2012/031131, mailed Oct. 17, 2013, 6 pages.

International Bureau, "International Preliminary Report on Patentability," issued in connection with international application serial No. PCT/US2012/031233, mailed Oct. 17, 2013, 12 pages.

International Search Report and Written Opinion received in PCT Application No. PCT/US2013/021466 issued on Aug. 16, 2013.

Office Action in corresponding U.S. Appl. No. 13/080,011 issued on Jan. 5, 2015.

Office Action in corresponding U.S. Appl. No. 13/079,949 issued on Jan. 16, 2015.

* cited by examiner

| HOLE | STROKE | CLUB | SPEED/ ACCELERATION | IMPACT POSITION | FORCE |
|---|---|---|---|---|---|
| 1 | 1 | DRIVER | 100 MPH | RIGHT OF CENTER | 2000 LBS |
| | 2 | 7-IRON | 75 MPH | | 1000 LBS |
| | 3 | 5-IRON | 75 MPH | | 1000 LBS |
| | 4 | PW | 75 MPH | | 1000 LBS |
| | 5 | PUTTER | 5 MPH | | 5 LBS |
| | 6 | PUTTER | 5 MPH | | 5 LBS |

SYSTEM AND METHOD FOR TRACKING ONE OR MORE ROUNDS OF GOLF

FIELD OF THE INVENTION

The present invention relates to tracking one or more rounds of golf. Particular example aspects of this invention relate to tracking rounds of golf by automatically recording a player's position and strokes.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level". One way for a golfer to improve their performance is to understand the layout of golf course itself and also understand their own performance "level" and skills and how to apply them to the golf course.

For example, in terms of understanding the golf course itself, a golfer may not be able to judge distances on the course between their position and a particular point, such as a hazard or the hole. As a result, the golfer might misjudge such distance between their position and the hazard or hole and select a golf club that would prevent the golfer from accurately striking the golf ball to the desired position. Therefore, it would be beneficial for the golfer to be able to know precisely where they are on the golf course and also how far they are from the hole or hazard in order to select the correct golf club with which to strike the golf ball. Hence, by understanding the golf course's layout, the golfer will improve their play on the golf course.

Similarly, in terms of a golfer understanding their own performance "level" and skills, a golfer may not have the experience to realize or judge their tendencies on the course, such as mistakes the golfer usually makes while on the course. For example, a golfer may not realize if they have a tendency to "slice" their drives from the tee box, "shank" their approach shots, "hook" their chip shots or leave putts too short. As a result, the golfer will not necessarily focus on improving that aspect of their "game". Golfers also tend to overestimate (or otherwise mis-estimate) the distances that they typically hit each club. Therefore, it would be beneficial to provide the golfer with a full and comprehensive reflection of the golfer's round, including the position of all the golf shots taken throughout the round, in order to allow the golfer to better understand his tendencies, mistakes, etc. and focus on correcting those aspects of their "game" during practice off the course. However, it is noted that the traditional method of golfing, including manual scoring, may not be adequate in providing that full and comprehensive reflection of the golfer's round discussed above and thereby, may not be substantially beneficial in helping the golfer realize their tendencies, mistakes, etc. In other words, while the golfer's manually created scorecard for a particular round may reflect how many shots were taken, it would not reflect information such as where on the actual golf course those shots were taken, if a golfer "sliced", "hooked" or otherwise mis-hit a shot, and/or the club used and the distances that the golfer hit the club for each shot. Instead, when reviewing a scorecard after the round, a golfer would have to rely solely on their memory to determine such information. Remembering all the different shots from a particular round can be difficult even if the round was played recently and especially if the round was not played recently. However, as described above, it is exactly such information about the position of the strokes or the mis-hits that can be a useful tool in helping the golfer improve. Therefore, it would be desirable to provide such information to the golfer so that they will better understand their own skills or "game" and thereby improve.

Further, an additional drawback to this traditional method of manual scoring is that it may be tedious and prone to error. For example, a golfer, especially one new to the game, may simply forget to record particular shots during the course of play. Before the golfer has a chance to record the score, they may forget a short chip stroke or putt they took during play. This can lead to errors in scoring. Alternatively, even if the golfer does remember to record all the strokes taken during a round, they would have to take time during play on the course to manually calculate and record this information. This can slow down the pace of play and take away from the game itself. For example, if the golfer did not have to spend time calculating and recording his score, the golfer could focus on and prepare for the upcoming golf stroke or upcoming hole. Therefore, it would be beneficial to eliminate the need for manually calculating and recording a score, so that the golfer can concentrate on other aspects of the game.

Therefore, as described above, analyzing and utilizing information from a round of golf both while on and off the course, is one way for a golfer to improve their own golf "game." While the industry has witnessed dramatic changes and improvements to golf equipment in recent years, there is room in the art for further advances in golf technology. Hence, it would be desirable to be able to automatically track a golfer's position, coordinate the golfer's golf strokes with the golfer's position and record such information. Further, it would be desirable to be able to display the tracked, coordinated and recorded information to the golfer.

SUMMARY OF THE INVENTION

The following presents a general summary of aspects of the invention in order to provide a basic understanding of the invention and various aspects of it. This summary is not intended to limit the scope of the invention in any way, but it simply provides a general overview and context for the more detailed description that follows.

Aspects of the invention relate to automatically tracking one or more rounds of golf. For example, aspects of this invention relate to systems and methods for tracking a golfer's position on a golf course and include a golf stroke information providing system for providing information about a golf stroke taken by the golfer (e.g., a golf stroke sensor, other data input means for providing data regarding a golf stroke). The systems and methods also may include a coordinating system to coordinate the information from the golf stroke information providing system with information about the golfer's tracked position on the golf course. The systems and methods also may include a recording system to record and store information about golf strokes taken by the golfer and information about the golfer's tracked position on the golf course. The systems and methods also may include a displaying system that allows a golfer to view the information recorded by the recording system.

According to other aspects of the invention, the tracking systems and methods according to this invention may include a global positioning device for tracking the position of the golfer on the golf course throughout the round of golf. Further, according to some embodiments of the invention, the global position device and the golf stroke sensor are both included in the golf clubs of the golfer.

According to still other aspects of the invention, systems and methods according to this invention may include devices for selectively activating and deactivating the global positioning device, the golf stroke information providing system and a transmitting system. According to some embodiments of the invention, activating and deactivating devices may include switches that activate and deactivate the global positioning device, the golf stroke information providing system and the transmitting system upon removal of a golf club from a golf bag.

BRIEF DESCRIPTION OF THE DRAWINGS

The present invention is illustrated by way of example and not limited in the accompanying figures, in which like reference numerals indicate similar elements throughout, and in which.

Figure 1:
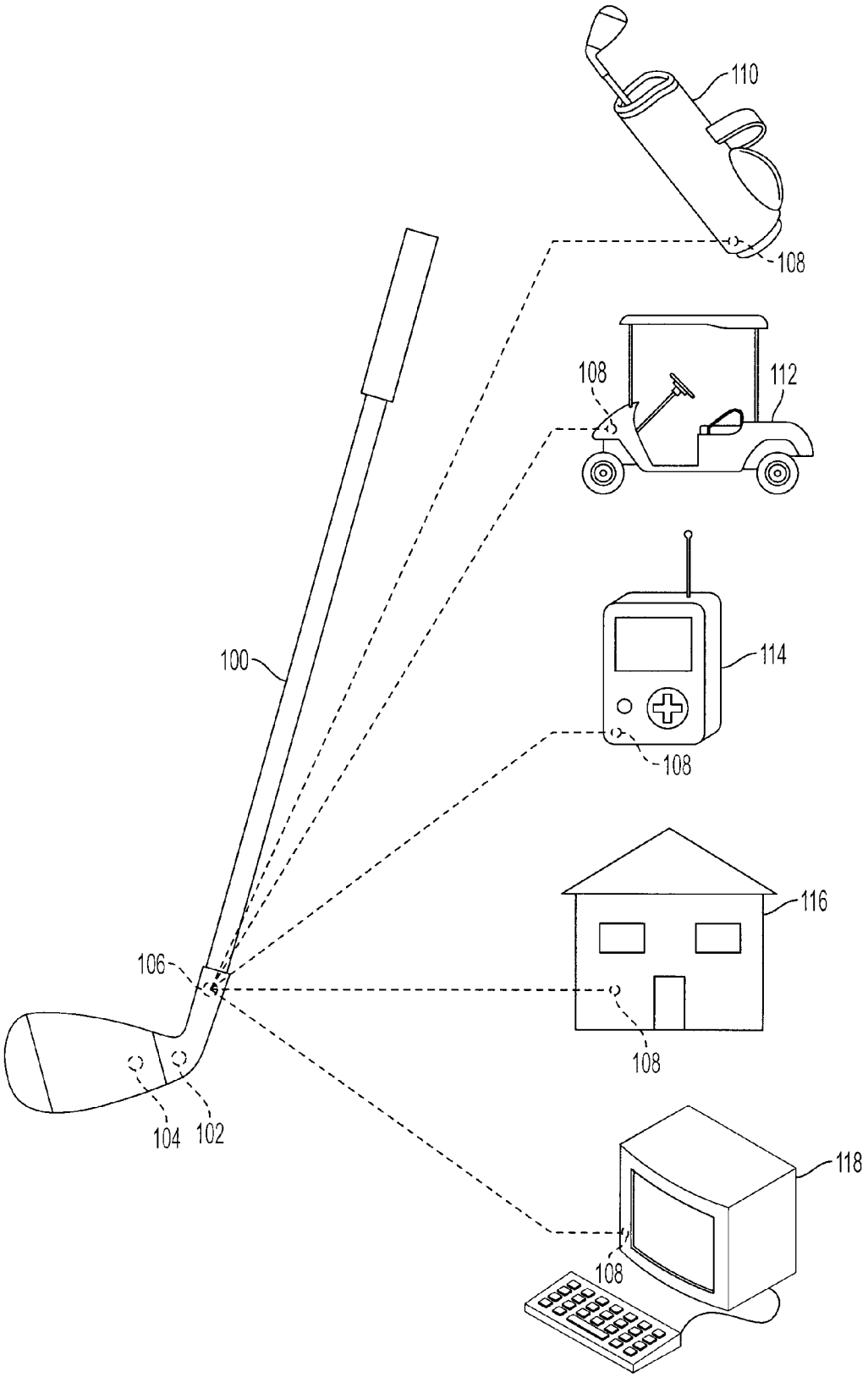
FIG. 1 generally illustrates features of an example embodiment for tracking a round of golf according to an aspect of this invention.

The reader is advised that the various parts shown in these drawings are not necessarily drawn to scale.

DETAILED DESCRIPTION

The following description and the accompanying figures disclose features of systems and methods for tracking rounds of golf in accordance with examples of the present invention.

I. GENERAL DESCRIPTION OF EXAMPLE SYSTEMS AND METHODS IN ACCORDANCE WITH THIS INVENTION a. Tracking the Position of a Golfer According to at least one aspect of this invention, a golfer's position is tracked and recorded throughout the round of play. In some embodiments, Global Positioning Satellite ("GPS") technology may be used to track a golfer's position on a golf course. The GPS includes a plurality of satellites orbiting the planet which transmit precise microwave signals. These signals allow a GPS receiver on the planet to determine its location, speed, direction and time. This technology has been widely used in countless activities, but may be applicable in the game of golf in accordance with this invention. For example, the GPS can be used to provide a golfer with their precise location on the golf course and also their distance to a particular position on the golf course such as a hazard or the hole. Therefore, based on such information, the golfer can determine which golf club to use in striking the golf ball or otherwise how to best play the hole. Another beneficial use of the GPS according to an aspect of this invention is that a golfer's position throughout the round, such as when they are taking a golf stroke, can be recorded and used later to analyze the round of golf.

b. Coordinating a Golfer's Position with Golf Strokes and Recording of the Same

Other aspects of this invention include a device that can determine if a golf stroke has been taken and, if so, which golf club was used to take of the golf stroke. According to particular embodiments, the devices may be sensors (which may include a processor or other technology) within the golf club. Therefore, by coordinating such information about the golf stroke with the positional information provided by the GPS device, via a coordinating system such as a processor, the position of the actual golf stroke and the club used to take the golf stroke can be tracked.

According to other aspects of the invention, particular embodiments may include one or more transmitters (which may include a processor) or other technology for transmitting and/or recording the GPS determined position of the golfer to a receiver (which may include a processor). According to still other aspects of the invention, the transmitter can also transmit to the receiver information or data described above regarding the golf stroke or the particular golf club used to the strike the golf ball. Therefore, one or more of: the golfer's position throughout the round, the position of an actual golf stroke and/or the golf club used to take the stroke may all be tracked and recorded during a round of golf.

c. Displaying the Transmitted and Recorded Information

Another aspect of the invention relates to displaying the recorded information. Embodiments of the invention are directed to a graphical layout of the golf course (or a portion thereof, such as one or more holes, a portion of a hole, the green, etc.) wherein the transmitted and recorded information can be superimposed on the graphical layout of the course. For example, the superimposed data can include the positions of where the shots are taken and lines between those positions representing the progression of the golfer to the hole and throughout the entire round. Further embodiments of the invention are directed to satellite images or pictures of the golf course (or a portion thereof, such as one or more holes, a portion of a hole, the green, etc.) wherein the transmitted and recorded information regarding the round of golf can be superimposed on the satellite images or pictures of the golf course.

d. Statistical Data Comparison

Another aspect of the invention is related to the ability to compile and organize statistical information about a golfer's round. For example, statistical data such as putts per hole, average distance of a drive from the tee, average distance for each particular club (e.g., a 7-iron), percentage of greens hit in regulation, percentage of fairway hits, average distance remaining to the pin on approach shots, putting statistics, etc., can be complied, organized and displayed for the golfer to analyze. Such statistical information can be organized however the golfer desires.

Given the general description of various example aspects of the invention provided above, more detailed descriptions of various specific examples of systems and methods of tracking a round of golf according to the invention are provided below.

II. DETAILED DESCRIPTION OF EXAMPLE SYSTEMS AND METHODS FOR TRACKING ROUNDS OF GOLF IN ACCORDANCE WITH THIS INVENTION

The following discussion and accompanying figures describe various example devices, methods and systems in accordance with the present invention. When the same reference number appears in more than one drawing, that reference number is used consistently in this specification and the drawings to refer to the same or similar parts throughout.

More specific examples and features of devices, methods and systems according to this invention will be described in detail below in conjunction with the example structures and other features illustrated in FIGS. 1 through 12.

FIG. 1 shows an example embodiment of a system for tracking a round of golf. As shown in FIG. 1, the example system of this illustrative embodiment is directed to a golf club 100 that includes within its structure both a GPS receiving and/or transmitting device (hereinafter "GPS device") 102 and a golf stroke sensor 104 which can determine if a golf stroke has been taken by the club, and, if so, it can transmit the identity of the golf club used to make the stroke.

In this embodiment, the position of the golfer is determined based on the position of the golf club 100. An advantage of having a GPS device 102 in the golf club 100 itself is that it eliminates the need for the golfer to use a portable, personal (e.g., handheld) GPS system in order to determine, track or record his position on the golf course. Therefore, by having the GPS device 102 within the golf club 100, the golfer does not have to alter any of their regular routine by carrying around extra items such as a portable device. Instead, a golfer merely has to play as they would under any other circumstances. As shown in FIG. 1, the GPS device 102 is positioned in the head of the golf club, but the GPS device 102 may be positioned anywhere practical in the golf club 100. Also, the GPS device 102 may be capable of providing identifying information about the golf club 100. For example, such information may be the type of golf club it is (e.g., a driver or a 7-iron), the owner of the golf club, etc. It is noted that such information may also be provided by the golf stoke sensor 104 and/or other electronics provided in the golf club (such as RFID technology, other data transmission technology, etc.). Golf clubs having electronics of the types described above are known in the art. For example, U.S. Pat. No. 7,004,848 to Konow, herein incorporated by reference, is an example of a golf club wherein identifying information is incorporated within the golf club and may be transmitted.

The golf club 100 shown in FIG. 1 containing the GPS device 102 along with the golf stroke sensor 104 may also include a transmitter 106 which receives information from the GPS device 102 and/or the golf stroke sensor 104 and sends that information to a receiver 108. This information sent by the transmitter 106 to the receiver 108 may include all the information from the GPS device 102 (e.g., the positional information) and from the golf stroke sensor 104 (e.g., identifying information). The receiver 108 may be located at a number of positions. For example, as shown in FIG. 1, the receiver 108 may be located in or on the golfer's bag 110, in the golf cart 112, in a hand held or user carried display device 114, at the golf course's club house 116, on a golfer's personal computer 118, etc. The receiver 108 may include or be in communication with a storage device for storing or recording the transmitted information. The storage device may be positioned with the receiver 108 or remote from the receiver 108. While the listed embodiments are examples of receivers 108 that may be employed, as long as the goal of receiving and storing the information is accomplished, any suitable receiver and/or storage device may be used without departing from this invention. In some systems and methods according to the invention, the receiver and/or storage devices will be portable devices carried by the golfer and/or on the golf equipment used during the course of the round and then connected to the user's computer 118 (or a clubhouse computer) after the round (e.g., via a wired or wireless connection) to download the collected data to another computer for further use and processing, e.g., by the golfer.

Therefore, according to the above example system and method according to the invention, coordinating information from the golf stroke sensor 104 with the positioning information provided by the GPS device 102, the position of the golfer, the position of the actual golf stroke, and the club used to take the golf stroke can be tracked and recorded. Also, the results of the stroke can be tracked and recorded, e.g., by utilizing the location of the user's next stroke.

According to particular embodiments of the invention, the golf stroke sensors 104 may be impact sensors that determine contact and impact of the golf ball with golf club head. An impact sensor could be positioned at or near the face of the golf club 100 in order to determine the impact between the golf club face and the golf ball. Therefore, these sensors would define and record a golf stroke as each impact of the golf club face with the golf ball. In addition to merely determining that the stroke has been taken, these impact sensors could also provide other particular information about the impact of the golf club with the golf ball. For example, the impact sensors could provide information indicating the part or position on the club face where the ball impacted and/or the force generated at the time of impact. Such information may be useful in conjunction with other data recorded. For example, as described below, the force of the impact and the part of the club head that impacted the golf ball can be used with the graphical representation of the golfer's round in order to help the golfer determine why a golf ball traveled a particular direction or a particular distance. Golf clubs having impact sensors of the types described above are known in the art. US Patent Publication No. 2005/0215340 A1 to Stites et al., U.S. Pat. No. 6,248,021 to Ognjanovic and U.S. Pat. No. 4,898,389 to Plutt, which are herein incorporated by reference, are examples of such impact sensors.

Other types of golf stroke sensors 104 within the scope of the invention are motion sensors that determine when the golf club 100 has been moved from a first position to a second position (e.g., gyroscope-type sensor). Therefore, these sensors would define and record a golf stroke as the movement of the golf club traveling along certain path. For example, these sensors could equate a single golf stroke as the golf club traveling uninterrupted from a resting position through a backswing and then through a follow-through on the forward swing. In addition to merely determining that the stroke has been taken, these sensors could provide particular information regarding the speed, acceleration, circular swing path, etc. with which the golf club is swung. Such information may be useful in conjunction with other data recorded. For example, as described below, the speed of the golf club and the swing path it followed can be used with the geographical representation of the golfer's round to help the golfer determine why a golf ball traveled a particular direction or a particular distance. Golf clubs having motion sensors of the types described above are known in the art. US Patent Publication No. 2005/0215340 A1 to Stites et al., US Patent Publication No. 2002/0173364 A1 to Boscha and U.S. Pat. Nos. 7,234,351 and 7,021,140 to Perkins, which are herein incorporated by reference, are examples of such motion sensors.

It is noted that the invention is not limited to use of a single sensor. In fact, more than one sensor may be used in a single golf club embodiment to determine that a stroke has been taken and also provide additional data about the stroke. For example, according to one embodiment, the golf club 100 may include both impact and motion sensors. Additionally, it is noted that any type of sensor may be used to practice this aspect of the invention provided that the determination of a golf stroke is reliably realized. While the position of the golf stroke sensor 104 shown in FIG. 1 is at or near the head of the golf club 100, the golf stroke sensor 104 may positioned at any practical position depending on the type of sensor used.

If desired, the golf stroke sensor 104 may be omitted and the user could manually activate a transmitter and/or otherwise input data into the system indicating that a stroke has been taken and/or the club used to take the stroke. Such systems for user manual entry of the data may be provided at least partially on the club itself, on the user's golf bag, on the user's golf cart, on a wrist-borne or other user carried device, etc.

Figure 2A:
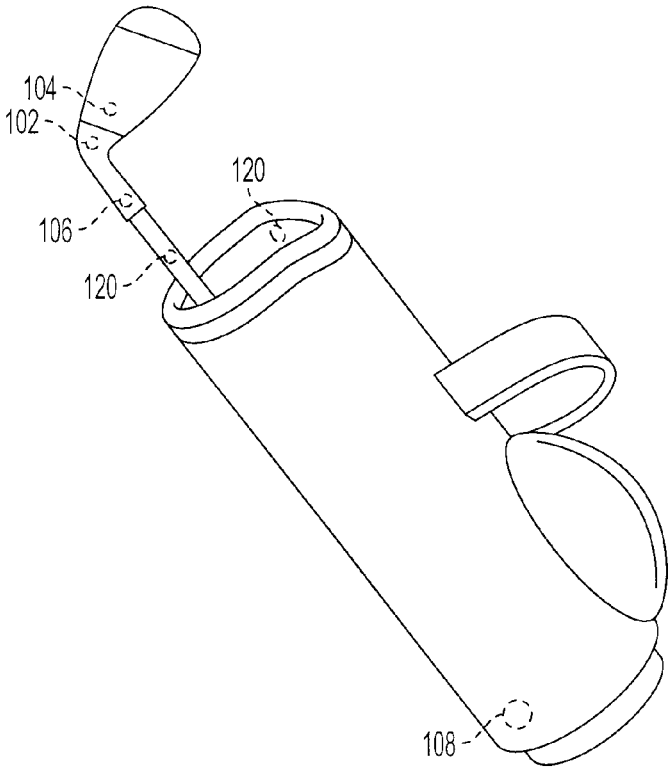
FIGS. 2A and 2B generally illustrates an example embodiment for activating features for tracking a round of golf according to an aspect of this invention.
Figure 2B:
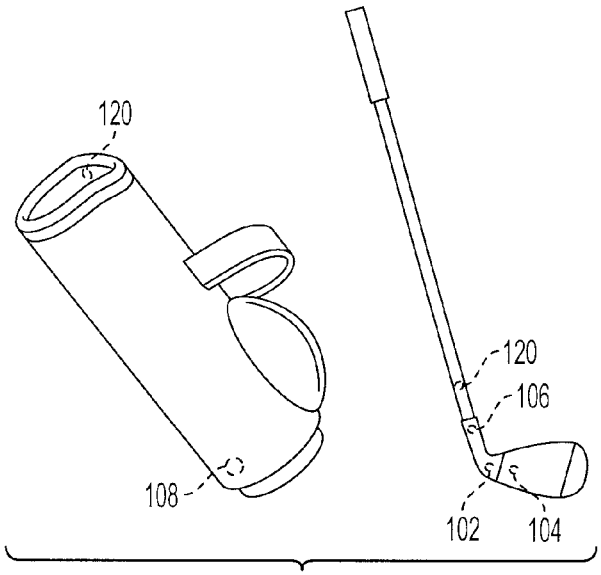

The GPS devices 102, golf stroke sensors 104 and transmitting devices 106 that are contained within the golf clubs 100 may be activated in a variety of ways. For example, in some embodiments as shown in FIGS. 2A and 2B, the GPS devices 102, golf stroke sensors 104 and transmitting devices 106 may be activated upon removing the golf club from the golf bag 110. For example, in the embodiment shown in FIG. 2B, the activation may be based upon activation of a proximity switch 120 that senses when the club 100 has been removed from the bag and, hence, upon such removal the proximity switch 120 activates the GPS device 102, golf stroke sensor 104 and transmitting device 106 in the removed club 100. Conversely, as shown in FIG. 2A, once the club 100 has been replaced in the golf bag 110, the proximity switch 120 deactivates the GPS device 102, golf stroke sensor 104 and the transmitting device 106 within the club 100. In this way, if the GPS device 102, golf stroke sensor 104 or transmitting device 106 contains a battery, then battery life may be conserved. Further, it is noted that if more than one golf club 100 is removed from the bag, then the GPS devices 102 in all of the removed golf clubs 100 would be activated. However, even if GPS devices 102 in the several removed clubs 100 are activated, the golf stroke sensor 104 would ensure that only the golf club 100 striking the golf ball would transmit the positional information about the actual golf stroke to be recorded. Alternatively, systems and methods according to some examples of this invention may query the golfer as to which of the clubs was used for the stroke.

Figure 3:
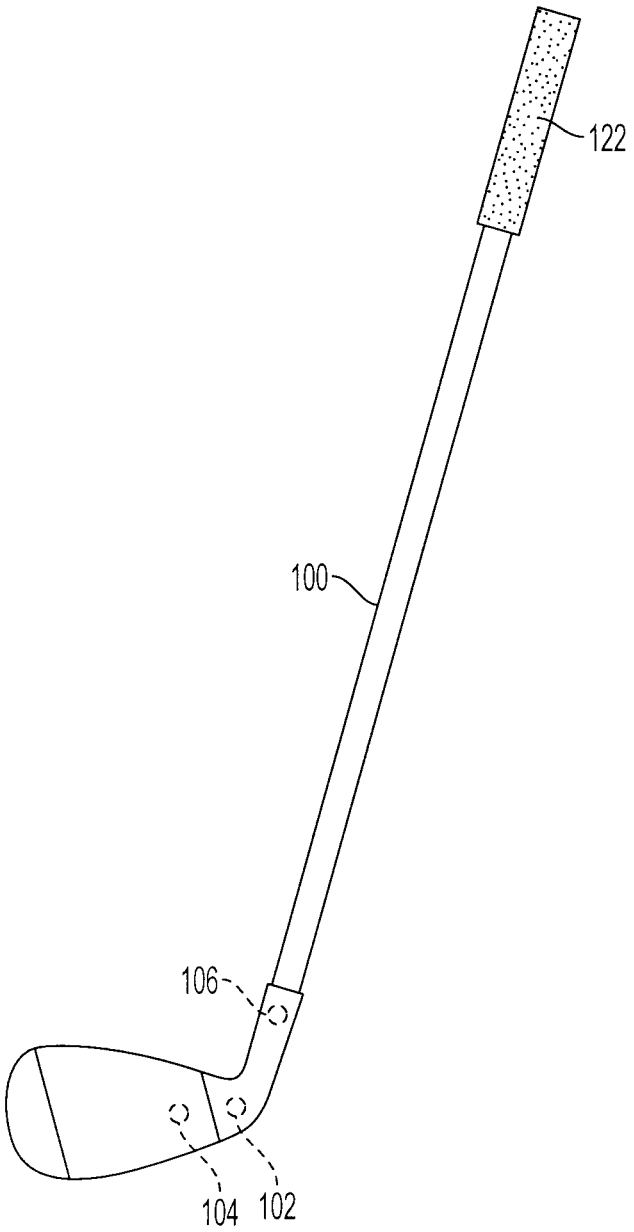
FIG. 3 generally illustrates another example embodiment for activating features for tracking a round of golf according to an aspect of this invention.

In another embodiment of the above described golf clubs 100 which is shown in FIG. 3, the GPS device 102, golf stroke sensor 104 and the transmitting device 106 may be activated by a pressure or touch sensor 122 provided in the handle of the club 100 that is activated when the golfer grips the handle. In this way, if the GPS device 102, golf stroke sensor 104 or the transmitting device 106 contains a battery, then battery life may be conserved. This pressure or touch sensor 122 feature may be used separately or in conjunction with other features of activating the GPS device 102, golf stroke sensors 104 or transmitting device 106 within the golf club 100.

Figure 4:
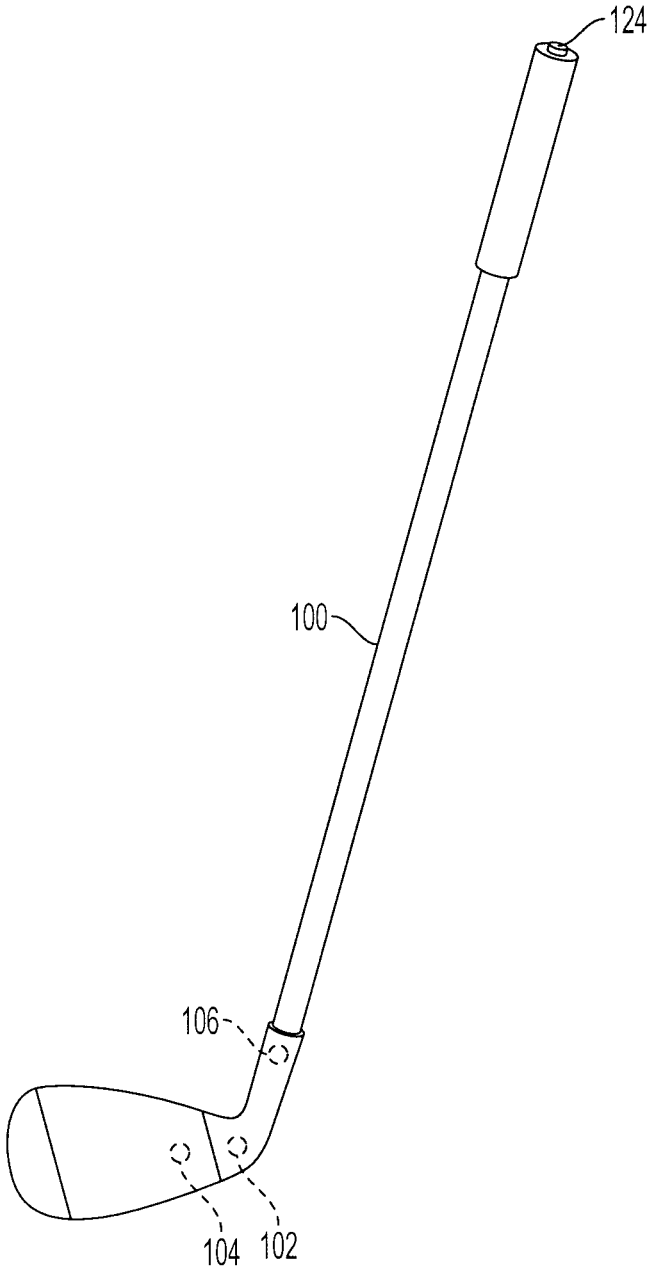
FIG. 4 generally illustrates another example embodiment for activating features for tracking a round of golf according to an aspect of this invention.

Another example for golf clubs 100 that may be used in systems and methods according to this invention is shown in FIG. 4. In this example structure, the golf club 100 includes a device for manually activating the GPS device 102, golf stroke sensor 104 and/or transmitting device 106, such as a switch 124. The switch may be activated at the beginning of a round and deactivated at the end of a round, or it may be activated each time the individual club is used. Each golf club 100 may contain its own switch 124 or their may be a single switch 124 that activates all the clubs within the golf bag 110. Also, this activation feature may be used separately or in conjunction with other features of activating the GPS device 102, golf stroke sensors 104 or transmitting device 106 within the golf club 100. Motion sensors also may be provided to activate the various electronics in the club, e.g., when a club undergoes a certain type of motion.

Further, it is noted that the example club structure including a manual switch 124 for activating and deactivating the sensors may be particularly beneficial to prevent practice swings from being recorded as actual strokes. For example, if the golf club 100 included gyroscope type sensors, which equate a single golf stroke as the golf club traveling uninterrupted from a resting position through a backswing and through a follow through on the forward swing, then the sensor may have to be deactivated via such as switch 124 during practice swings so that those practice swings are not counted as actual golf strokes. The use of the manual switch of this type also can obviate the need for an impact sensor 104 in the club head. If desired, activation of the manual switch 124 (e.g., after a stroke or before the stroke) may transmit the GPS location information, the club identifier information (e.g., six iron), and/or the stroke count increment information.

Regardless of how the GPS device 102, golf stroke sensor 104 and/or transmitting device 106 are activated, once they are activated, the above described transmission of the stroke sensor (or stroke counter information), the GPS information, and/or the club identifier information may be accomplished in a variety of ways. For example, according to one embodiment, the GPS device 102 within the golf club 100 may be receiving positional information from the satellites and when a stroke is taken with a golf club 100, the golf stroke sensor 104 in the golf club 100 activates the transmitter 106 and which transmits to the receiver 108: the positional information from the GPS device, the stroke information from the golf club sensor (e.g., the fact that a stroke was taken), and the identifying information about the golf club. In this way, all the information is transmitted to the receiver 108 in a single transmission upon each stroke taken. In an alternative embodiment, the GPS device 102 could constantly transmit positional information to the receiver 108 and the stroke information would be transmitted upon each stroke taken (e.g., in response to the stroke sensor or in response to manually input information indicating that a stroke was taken). In other words, the receiver 108 could be programmed to record GPS positional information and correlate it to a stroke when it receives an indication that a stroke has been taken. Therefore, as can be understood by these example embodiments, the coordination of the information can be done prior to transmission (e.g., in the club 100) or after transmission (e.g., at the receiver 108).

Regardless of how the position of the golfer, the position of the golf stroke, the club identification, and other information about the golf stroke or golf round is coordinated and transmitted via a transmitting system, as described above, all the information may recorded to a storage medium. The storage medium could be located in a golf bag 110 (e.g., a portable storage device contained within the golf bag), on the golf cart 112, as part of a personal handheld or wrist-borne (or other portable) device 114, at the clubhouse 116, etc. If recorded on a temporary storage medium (e.g., a hand held system or disk at the club house which the golfer can take home), then later, this recorded information may then be uploaded, or otherwise transferred, to another storage system (e.g., the golfer's personal computer 118, an Internet website, etc.).

Figure 5:
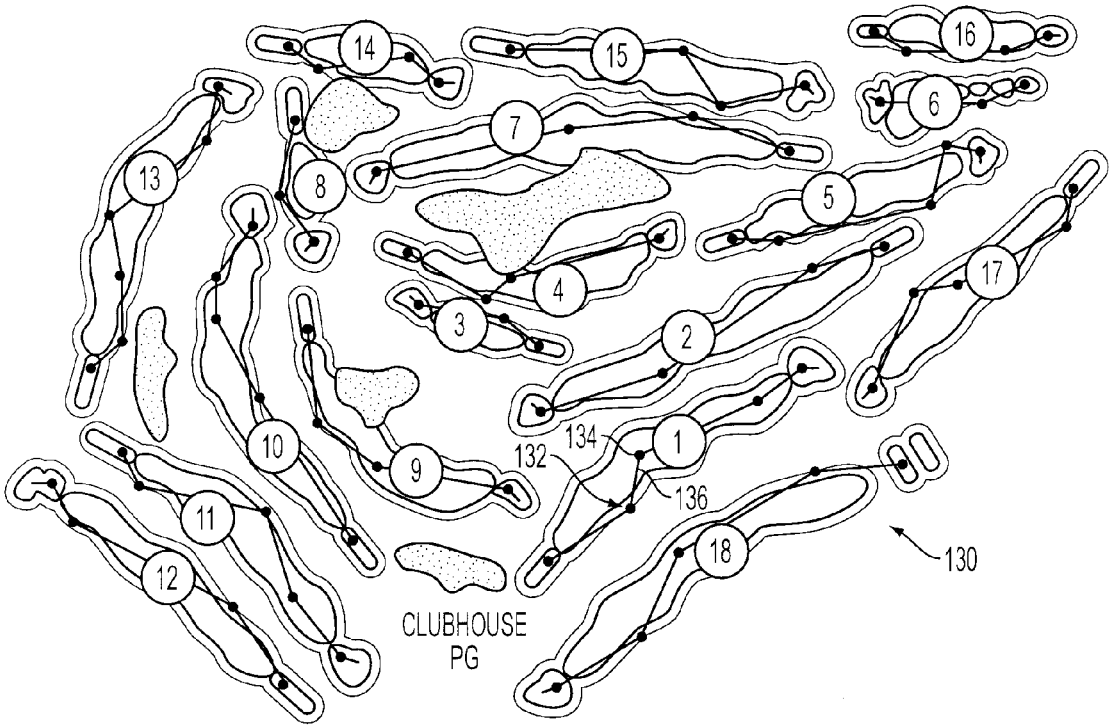
FIG. 5 generally illustrates a graphical display of a tracked and recorded round of golf according to an aspect of this invention.

The storage system relates to another aspect of the invention illustrated in the example structure shown in FIG. 5. In this system, the stored or recorded information relating to the round of golf is displayed to the golfer. In the particular embodiment of the invention shown in FIG. 5, a graphical layout of a golf course 130 is displayed wherein the transmitted and recorded information 132 relating to one or more rounds of golf can be superimposed on a graphical layout of the course 130. The graphical layout of the golf course 130 can be uploaded to the storage device prior to or after the round of golf. For example, the superimposed data can include the positions of where the shots 134 are taken and lines 136 between those positions representing the progression of the golfer to the hole and throughout the round.

Figure 6:
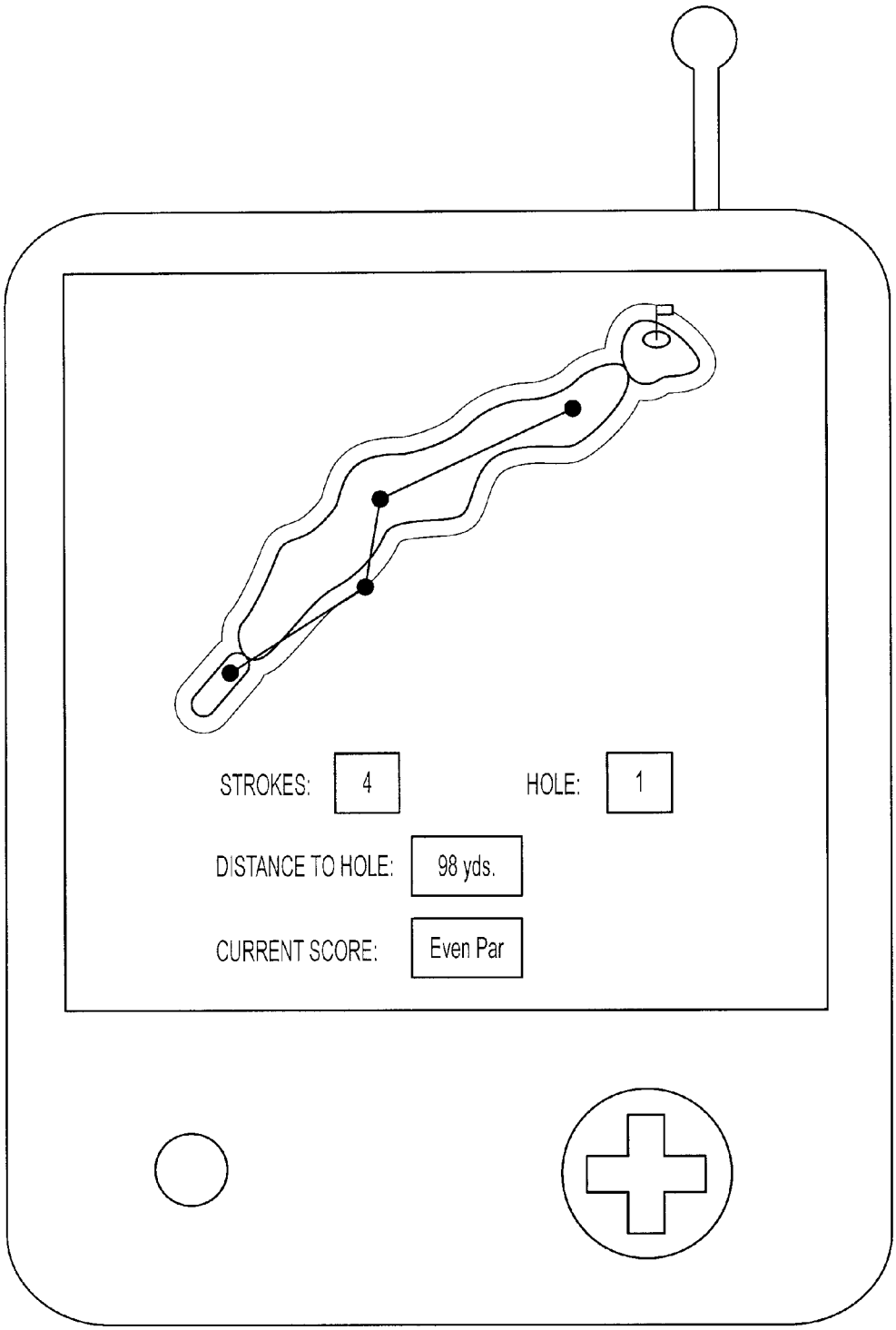
FIG. 6 generally illustrates a graphical display of a tracked and recorded round of golf on a display device according to an aspect of this invention.

As shown in FIG. 6, particular embodiments of this display aspect of the invention are directed to the storage medium including a display the golfer can use while on the course (e.g., a handheld device 114 or golf cart 112 system) which shows the graphical layout of a golf course 130 and/or an individual golf hole and transmitted or recorded information 132. Therefore, the transmitted and recorded information 132 can be used by the golfer during the round. For example, as shown in the FIG. 6, the golfer can use the graphical layout of a golf course hole 130 and the transmitted information 132 displayed in the handheld device 114 to determine precisely where they are located on the golf course, distance to the hole, their current score, etc.

Further, the transmitted and recorded information 132 can also be useful after the round is over. As mentioned previously, realizing and understanding information about the golfer's particular round would be beneficial to the golfer in improving their game. Further, being able to view or "play back" a depiction of all the golfer's strokes during the round superimposed on the representation of the golf course, as shown in FIG. 5 and/or FIG. 6, would be useful in aiding a golfer to better realize and understand particular aspects of their game and/or their true capabilities and tendencies during play. The depiction of the golfer's round can be viewed via a playback mode where the progression of the round through the graphical layout of the course 130 or individual holes (or portions thereof) can be viewed stroke by stroke. Also, the depiction of the golfer's round can be viewed via a playback mode where the progression of the round utilizes satellite images or pictures. Alternatively, the round can be viewed with all the shots already superimposed on the course layout 130 or on satellite images or pictures. For example, by viewing the round in such a manner, the golfer could easily see if they have a tendency to miss shots in a particular direction such as a "slice" to the right or a "hook" to the left of the intended direction of the ball flight path. Alternatively, or in addition to, the golfer could see if they take a several "approach" shots per hole and thereby negatively affect their score.

As some more specific examples, golfers tend to overestimate the distance they will hit a club. Aspects of this invention can assist the golfer with this problem in at least two ways. First, by tracking the distance each individual club is hit (over one or multiple rounds), a golfer can have a better understanding (backed by data) of how far he/she hits the ball with each club (e.g., the average distance that they hit a six iron). This can greatly assist the golfer in club selection in future rounds. Second, by visually seeing the locations of the shots during a round superimposed (or otherwise represented) on a representation of the golf course, golfers can get a better feel of where they tend to miss shots on approaches or at other locations (e.g., are they consistently left, consistently right, etc.), which can assist in their alignment, aiming, etc.

These are just examples of information that can be obtained from viewing such a representation of the golfer's round, but the underlying point remains that such a representation can provide valuable insight on particular features of the golfer's performance level, ability, skills, habits, etc. The golfer can then work to correct that aspect of their game now that they understand it and visually see how it affects their play on the golf course. Further, the fact that the tracking, recordation and display of the round of golf can all be done automatically (at least in some example systems and methods according to the invention), is beneficial to the golfer because it saves the golfer considerable time and effort in analyzing the round of golf.

It is also noted that the graphical representation of the round of golf may make is easy for a golfer to see particular tendencies or repeated mistakes. For example, as shown in FIG. 5, the display feature of the invention includes a depiction of shots 132 over a layout of the golf course 130. The depiction of the shots 132 shows that the over the course of the round, several of the drives from the tee boxes are hit to the right of the fairway and, therefore, the golfer can easily see that he has repeated this mistake several times. This visualization of the mistake occurring several times can be valuable teaching aid for the golfer and he can use this to improve his "game," e.g., by seeking professional advice, by changing alignment characteristics, etc.

Figure 7:
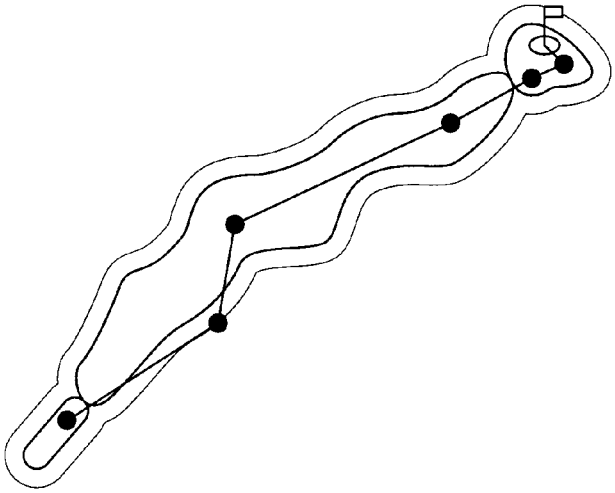
FIG. 7 generally illustrates a graphical display of a tracked and recorded round of golf in accordance with related statistical data according to an aspect of this invention.

Another aspect of the display feature is its ability to be used in conjunction with the information about the golf stroke provided from the golf stroke sensors 104. For example, in at least some example systems and methods according to this invention, the golf stroke sensors 104 can provide information about the golf stroke, such as force of impact, where on the club head the impact with the ball occurred, speed or acceleration of the golf club 100, swing path of the golf club 100, etc. As shown in FIG. 7, this information can be useful when used with the graphical display of the golfer's round. For example, as seen in FIG. 7, the impact sensor 104 provides certain information including that an impact was to the right of the center of the club face of the driver for the stroke off of the tee box at the first hole of the golf course. As seen in FIG. 7, such impact information can be shown graphically or via text. This information may be particularly useful when combined with the display feature of the invention because, as seen, the display device may show that the position 134 of the golf ball at the subsequent shot was out of the first hole's fairway in a particular direction. This information of the position of the golf ball after being struck combined with the information of the golf ball's impact location with the golf club indicates that a golfer may have mis-hit a stroke. Therefore, this information further allows the golfer to understand how and why the golf ball was mis-hit. With this knowledge of how and why the ball was mis-hit, the golfer would be able to use such information to attempt to correct the mistake in the future (e.g., by standing closer to or farther from the ball at address, by altering alignment, etc.). Such features also may be used without the GPS data, if desired, for example, on the practice range as the golfer works on his/her swing.

Statistical Data Comparison

Another aspect of the invention is related to the ability to compile and organize statistical information about a golfer's round. For example, statistical data such as putts per hole, average distance of a drive from the tee, or average distance for each particular club (e.g., a 7-iron) can be complied, organized and displayed in order for the golfer to analyze. Such statistical information can be organized however, the golfer desires. For example, if the golfer is interested in how many holes on which they scored par or below, they can organize the statistical data to show such information. Statistical data like that tracked for PGA professionals (e.g., like the data and/or various individual statistics compiled by the SHOTLINK® system (SHOTLINK®) is a registered trademark owned by the PGA Tour, Inc. of Ponte Verde Beach, Fla.)) may be tracked and maintained for an individual golfer using systems and methods in accordance with this invention.

Further aspects of this invention relate to incorporating the statistical information of a particular round with statistical information from other rounds that the golfer has played to create historical data for the golfer. By using this historical data, the golfer can see if aspects of their game are varying or improving over time. For example, the historical data can tell the golfer if his average distance of a drive is improving over the course of a season. As another example, through this historical data, a golfer can tell if he or she is reducing their tendency to, "slice" or "hook" the golf ball during a golf shot, such as a drive. Other information that can be interpreted in light of this historical data feature is how far the golfer usually "hits" a particular club (i.e., the distance the ball usually travels when the golfer strikes it with a particular club); the number of fairways usually hit during a round, the number of putts per hole, greens hit in regulation, etc.

Another advantage of the storage aspect of the present invention is the fact, the information of the recorded round can be easily saved and retrieved in the future. For example, in order to see how a golfer has progressed over the course of a particular period of time (e.g., a year) a golfer can easily and quickly retrieve any or all rounds of golf played and saved within that time period. These rounds or data from these rounds may be compared with each other (e.g., on an individual club basis, on an overall score basis, etc.). In this way, a golfer can quickly and easily determine if there has been improvement or not and focus their efforts on particular aspects of their game which have not improved. The feature also may be useful to compare the performance of one club (e.g., an initial driver) with another (e.g., a new driver). Additionally, the ability to use this historical data will allow the golfer to learn their tendencies on a particular golf course. For example, if a golfer plays a particular golf course several times or at least more than once, they can look at the statistical data (e.g., the raw data for a particular hole or superimpose the several rounds at the same course on top of each other) in order to discover, compare, and/or otherwise analyze their tendencies on that particular course.

Figure 8:
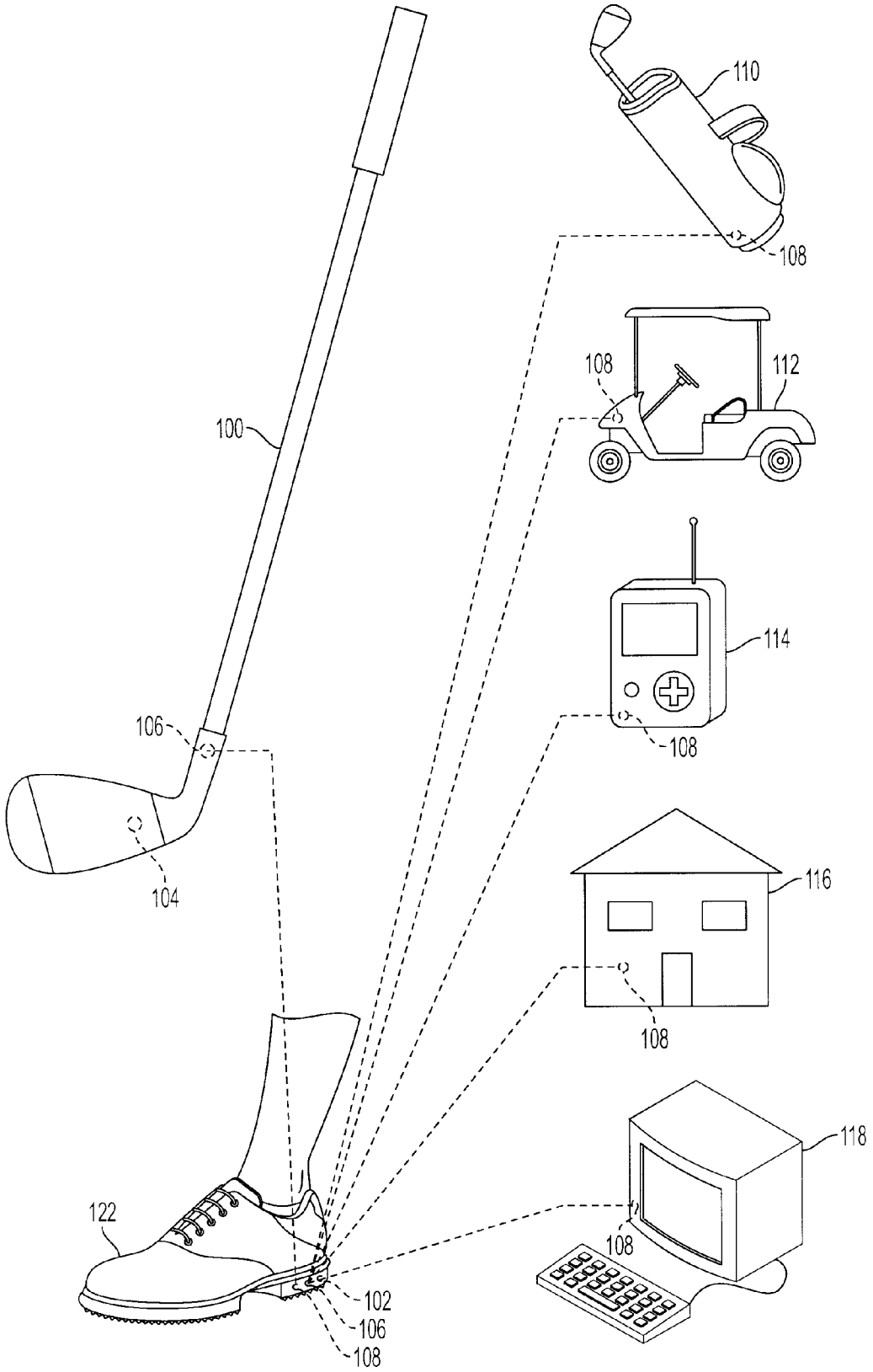
FIG. 8 generally illustrates features of an example embodiment for tracking a round of golf according to another aspect of this invention.

While a system of tracking the golfer has been described according to a GPS device 102 included in the structure of a golf club 100, this is not to suggest that the GPS device 102 must be contained in the golf club 100. In fact, according to other embodiments, the GPS device 102 is not contained within the golf club 100. For example, the GPS device 102 may be a portable device carried by the golfer or attached on the golfer's person. As shown in the example illustrative embodiment shown in FIG. 8, a golf club 100 includes a golf stroke sensor 104 within the golf club 100, however, the GPS device 102 is separate from the golf club 100. As seen in FIG. 8, the GPS device 102 is attached to golfer's person. In the embodiment shown, the GPS device 102 is located in the golfer's shoe 122, but it may be located anywhere within golfer's immediate range. Therefore, because the GPS device 102 (carried by, or attached to, the golfer) is already at the golfer's position on the course, the GPS device 102 can accurately identify the position of the golfer and the position of the stroke (e.g., when the stroke identifier information is correlated with the positional information). An advantage of this embodiment is it provides the GPS device 102 to the golfer in a way that would prevent the golfer from having to carry an additional item (e.g., carrying a hand-held device that the golfer would not normally carry anyway). In other words, because the golfer would have to wear his golf shoes 122 on the course anyway, providing the GPS device 102 in the golf shoe 122 would not interfere with or cause the golfer to alter his routine in any way. Further, this embodiment can provide an alternative to the having a GPS device 102 in golf club 100 that a golfer would use on the golf course.

As described above, information from both the GPS device 102 and the golf stroke sensor 104 may be transmitted to a receiver 108 in a variety of ways. For example, according to one embodiment, as shown in FIG. 8, once a stroke is taken, the information from the golf stroke sensor 104 may be transmitted to the GPS device 102 or other processor (e.g., the GPS device or other processor in the golfer's shoe). Once the GPS device 102 or other processor receives that information from the golf stroke sensor 104, it can be coordinated with the GPS device's positional information and, further, if desired, the coordinated information can be transmitted to another receiver 108. Alternatively, if desired, all of the data may be stored on a processor and/or memory device kept with the golfer and later downloaded to another device.

Alternatively, as described above in reference to FIG. 1, any of the information (e.g., the GPS position, the club identifier information, and the stroke sensor information) may be separately transmitted to a receiver 108 or transmitted in any desired manner or order. In other words, the GPS device 102 may send out a constant transmission to the receiver 108, and the golf stroke sensor 104 will send out a transmission upon the golf stroke being taken (which information also may include club identifier information). In this way, once the receiver 108 has received the transmission from the golf club 100 that a stroke has been taken, it will automatically determine where on the course that a stroke was taken, based on the contemporaneous transmission from the GPS device 102. Therefore, the receiver 108 will coordinate that position on the golf course as the position from which the stroke has been taken. As another alternative, if desired, the stroke information (e.g., that the stroke happened and/or a club identified) may include a time stamp that can be later correlated to the time stamped GPS positional information.

Hence, depending on the embodiment, the coordination of the information can be done prior to transmission to the receiver 108 (e.g., in the GPS device 102 or other processing system) or after transmission (e.g., at the receiver 108). The receiver 108 may be located at a number of positions. For example, as shown in FIG. 8, the receiver 108 may be located in the golfer's bag 110, in the golf cart 112, as part of a hand held display 114, at the clubhouse 116, on a golfer's (or other entity's) personal computer 118, etc. As discussed above, the receiver 108 may include or be in communication with a storage device which may be positioned with the receiver 108 or remote from the receiver 108 (e.g., via an Internet or other network connection, etc.). While the listed embodiments are examples of receivers 108 that may be employed, as long as the goal of receiving and storing the information is accomplished, any suitable receiver may be used.

The above described embodiments are not intended to suggest that the scope of the invention does not include a separate GPS device 102 that is carried by the golfer, even if the GPS device 102 would not necessarily be part of his original routine. For example, according to other embodiments of this invention, the GPS device 102 may, in fact, be embodied in a portable, handheld device 114 that is carried by the golfer specifically and primarily for the purpose of tracking the round of golf. While this embodiment would require the golfer to carry the additional device which may add to the amount of equipment the golfer carries, depending on the GPS device itself, this embodiment may provide advantages, such as being able to display the GPS information to the golfer while they are on the course. In this embodiment, the golfer may be able to use the displayed GPS position on the GPS device display to accurately determine the golfer's position to a hazard or the hole and, hence, best determine how to play the golf stroke (e.g., which golf club to select, distance to reach the green or clear a hazard, etc.).

Figure 9:
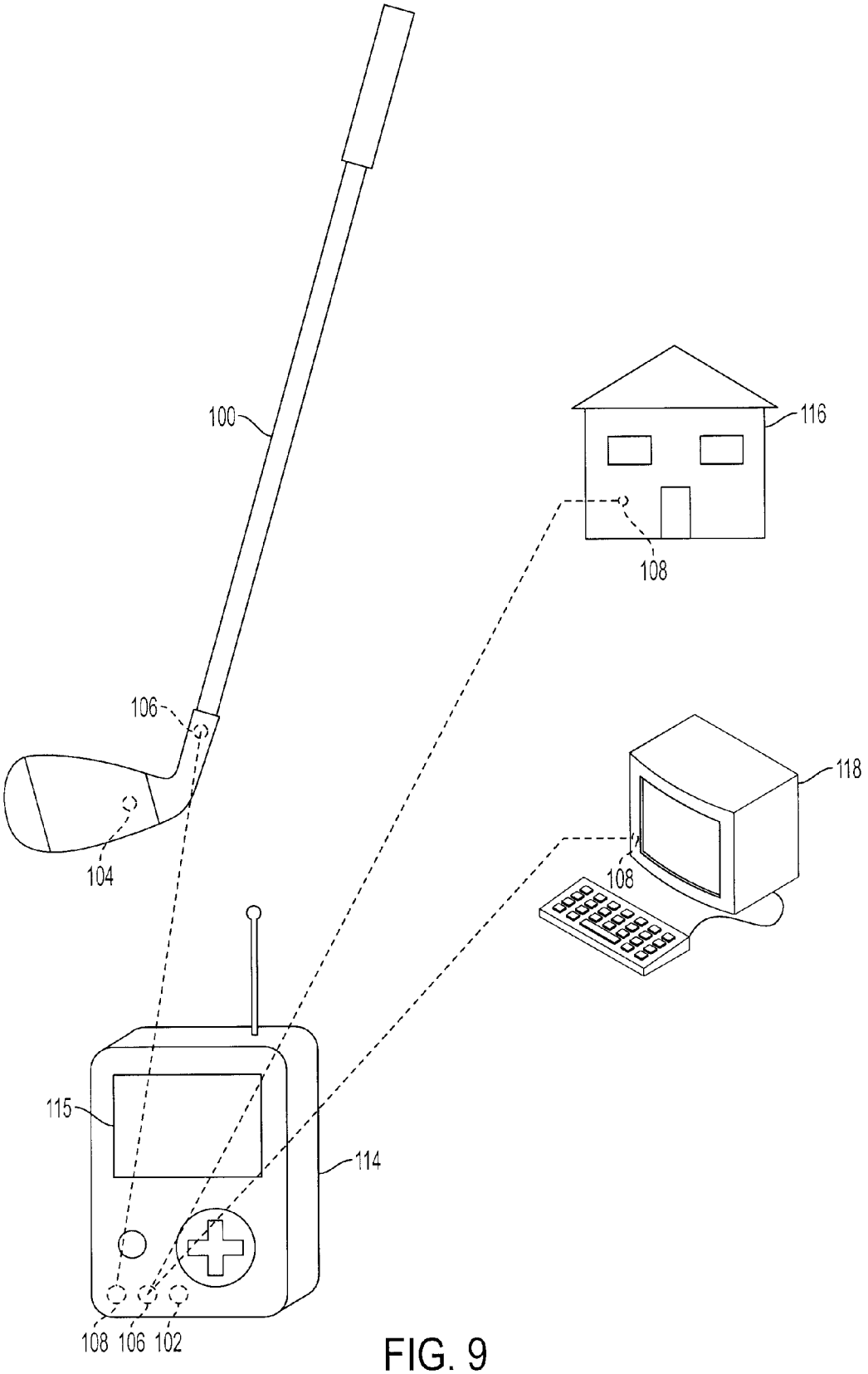
FIG. 9 generally illustrates features of an example embodiment for tracking a round of golf according to another aspect of this invention.

An example illustrative embodiment according to this aspect of the invention is shown in FIG. 9 and is directed to a golf club 100 that includes a golf stroke sensor 104 within the golf club 100. Like the illustrative embodiment represented in FIG. 8, in this embodiment, the GPS device 102 is separate from the golf club 100. However, unlike the embodiment shown in FIG. 8, the GPS device 102 in this embodiment includes a display device 115. In the embodiment shown in FIG. 9, the GPS device 102 may be located with the golfer (e.g., clipped to a belt; wrist-borne; included as part of a cellular telephone or other generic GPS device or a special "golf only" GPS device with downloadable schematics of the golf courses, MP3 player, pager, PDA, or other electronic device, etc.) and provide a display 115 that allows the golfer to use the GPS to determine the golfer's position while on the course. Specifically, in FIG. 9 this GPS device 102 is embodied by a personal, portable GPS device (e.g., hand-held device such as a cellular telephone phone or other generic GPS device or a special "golf only" GPS device with downloadable schematics of the golf courses) 114. In such embodiments, the GPS device 102 embodied by the personal, portable GPS device 114 would be large enough to also contain a storage device (e.g., a memory). Therefore, the golf club sensor 104 can send out a transmission to the GPS device 102 embodied by the personal, portable GPS device 114 upon the golf stroke being taken (or the golfer could manually send out an indication that a stroke has been taken and/or the club used to take the stroke) and the GPS device 102 embodied by the personal, portable GPS device 114 can coordinate the stroke information with its own positional information and record the information in the storage device. Further, that coordinated information can be transmitted by the GPS device 102 embodied by the personal, portable GPS device 114 via a transmitter 106 to a receiver 108 and/or another storage device located at the clubhouse 116, on the golfer's (or other entity's) personal computer, etc. Alternatively the stored coordinated information may be uploaded to another storage device such as a server that is connected to the golfer's personal computer 118 via a networked connection after the round is over. Also, it is noted that the data stored in the personal, portable GPS device 114 may be downloadable from the personal, portable GPS device to a separate device, for example a memory stick, so that the golfer can personally upload the data to another storage device such as a personal computer 118.

According to other embodiments of the invention, the GPS device may be a system contained in the golf cart 112. In such an embodiment, the position of golfer or the golf stroke recognized by the GPS device 102 would be coordinated to the position of the golf cart 112. Therefore, the precision and accuracy of the GPS reported position of the golfer or stroke will be dependent on the proximity of the golf cart 112 to the actual golfer or golf stroke location.

Figure 10:
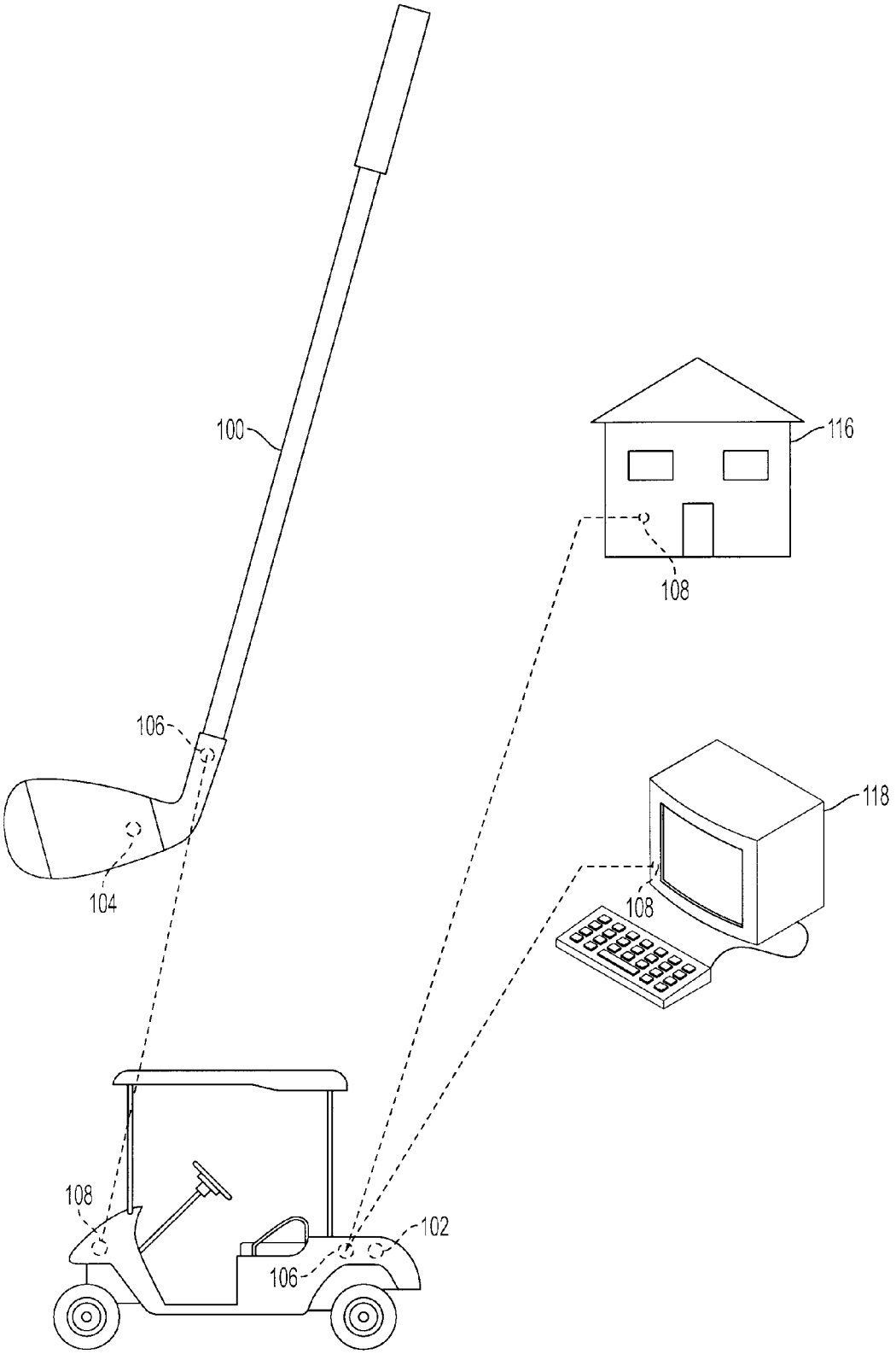
FIG. 10 generally illustrates features of an example embodiment for tracking a round of golf according to another aspect of this invention.

Such an example illustrative embodiment is shown in FIG. 10 and is directed to an embodiment similar to the embodiment described with reference to FIG. 9, however, the GPS device 102 is a golf cart based GPS system. Alternatively, if desired, the GPS system could be attached to or otherwise included with the golfer's bag (with the same precision and accuracy caveats noted above for the cart mounted GPS). All other features of these embodiments are described in reference to the embodiment shown in FIG. 9. For example, similarly to the embodiment shown in FIG. 9, it is noted that the data stored in the golf cart based tracking system may be downloadable from the cart 112 or receiver within the cart 112 to a separate device, for example a memory stick, so that the golfer can personally upload the data to another storage device such as a personal computer 118. Therefore, the similar features described with reference to the cart based or golf bag based systems are not reiterated here for the sake of brevity.

Figure 11:
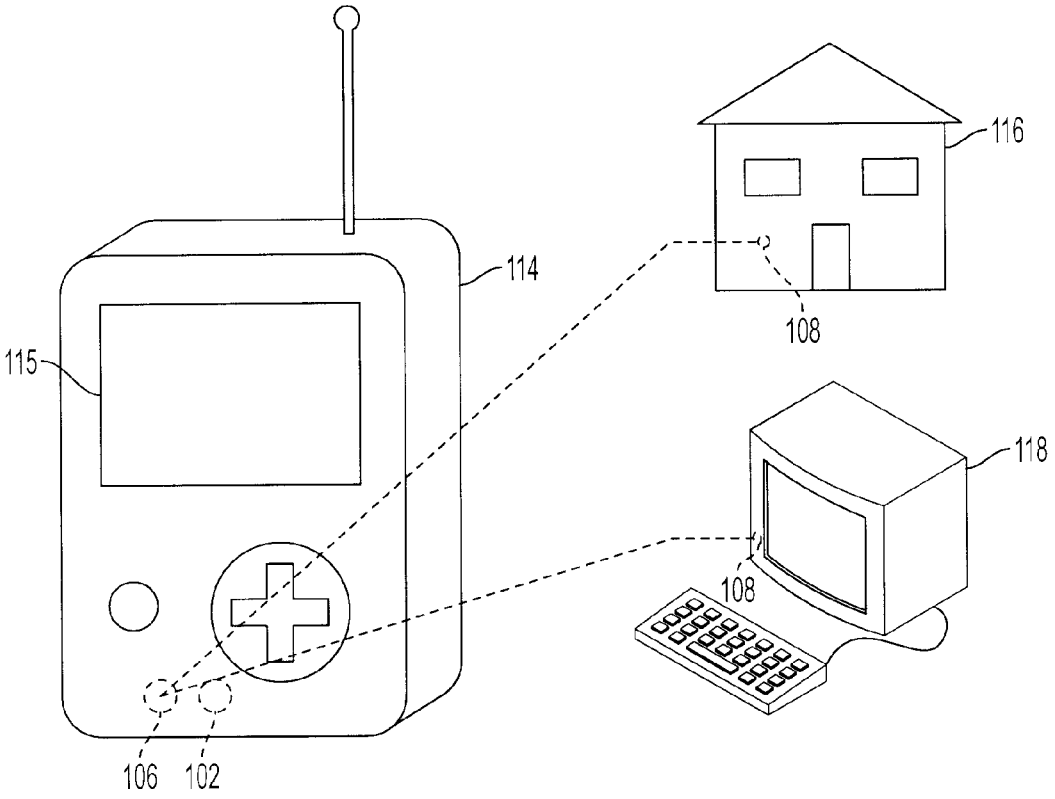
FIG. 11 generally illustrates features of an example embodiment for tracking a round of golf according to another aspect of this invention.

According to particular embodiments of the invention, the determination and recordation of the stroke may be done manually as opposed to automatically. For example, the example illustrative embodiment shown in FIG. 11, is directed to an embodiment wherein manual recordation of the stoke takes place. For example, in this embodiment, a golfer's GPS position is determined via a personal, portable GPS device 102 (e.g., hand held device GPS device), and the golfer manually inputs into the personal, portable GPS device 102 that a stroke has been taken. Because the GPS device 102 will already have determined where the golfer is positioned when they enter the input that a stroke has been taken, it will coordinate that position on the golf course as the position from which the stroke has been taken. Therefore, the golfer can manually create a record of where on the golf course each stroke during the round was taken. Additionally, the golfer may enter which golf club 100 was used for the stroke, thereby enhancing the record of the round of golf. Entering the input could be done in a variety of ways. For example, instead of manually keying in the information, the system could recognize voice commands or other auditory signals.

Figure 12:
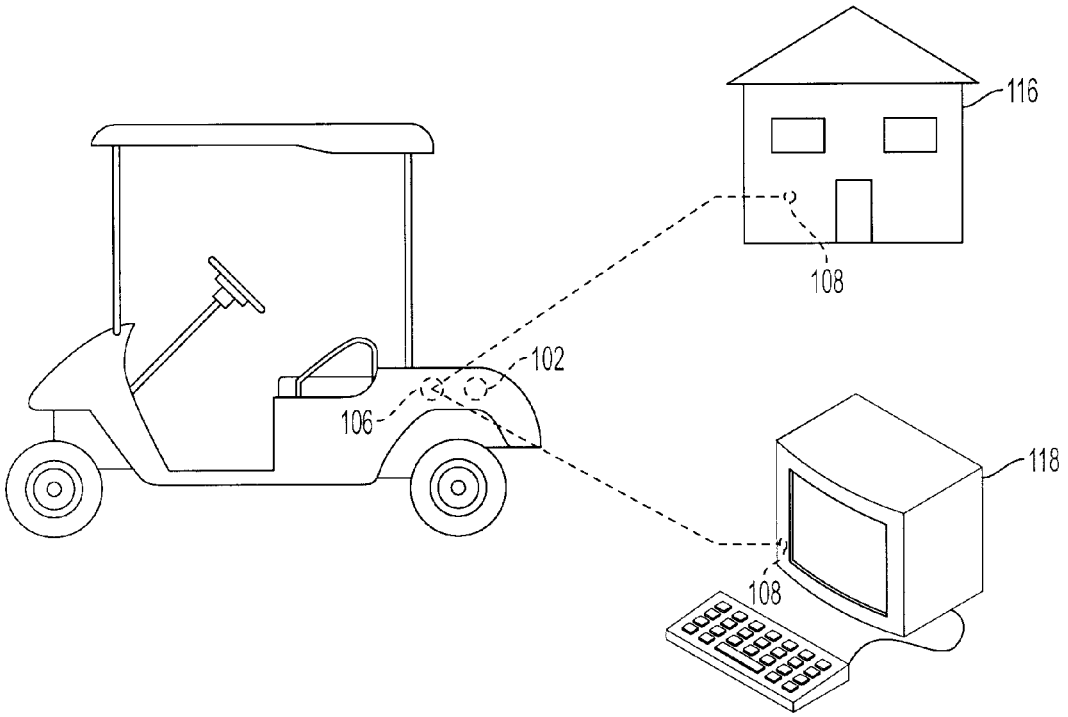
FIG. 12 generally illustrates features of an example embodiment for tracking a round of golf according to another aspect of this invention.

The example illustrative embodiment shown in FIG. 12 is directed to an embodiment similar to the embodiment described with reference to FIG. 11, however, the GPS device 102 is a golf cart based GPS system. All other features of this embodiment are described in reference to the embodiment shown in FIG. 11 and therefore not reiterated here for the sake of brevity.

Other Potential Features of Systems and Methods According to the Invention

Systems and methods according to this invention may include a wide variety of additional features. For example, systems and methods according to at least some examples of this invention may track, for each shot, the distance away from the hole when that shot was taken and the distance left to the hole once this shot was completed (i.e., the distance away from the hole both before and after the shot). This information may be useful in various ways. For example, it would allow a user to determine which clubs used on approach shots tend to leave the golfer closest to the pin. As another example, the distance away from the hole before a shot is taken may be useful to exclude certain data from shot distance calculations. For example, many golfers use 7, 8, 9, or other clubs around the greens for pitch and chip shots. If this data were included in the regular shot length data for these clubs, it would skew the results indicating, on average, that the user hits these clubs much shorter than he/she actually does. By noting that the golfer was only a short distance from the pin before a shot was taken, systems and methods according to examples of this invention may eliminate these chip shots or half shots from the full shot data and thereby provide the golfer with improved and more accurate information.

Additional features for the round "play back" also may be provided in accordance with this invention. For example, when analyzing the round on the computer, a user may be able to look at the hole on the display and "drill down" to obtain more information relating to the shot (e.g., to obtain a graphical display of any of the information collected relating to the shot, as described above). As another example, if desired, weather, wind, and/or other course condition information may be provided and stored in systems and methods according to the invention (e.g., automatically downloaded and stored when the golfer "sets up" or starts his round using systems and methods according to the invention, manually input, etc.) so that this information may be maintained along with the data relating to the individual round.

Any type of play back features may be provided without departing from this invention. The playback could be relatively simple, such as an overview of the golf course (or a portion thereof) with the golfer's shots overlaid thereon (with graphical user interface elements provided to allow the golfer to obtain more information about any given shot). Of course, if desired, more animated features may be provided without departing from this invention, including features of the course and the shots in a manner similar to conventional video games, such as TIGER WOODS PGA TOUR 08 available from EA Sports. As an additional feature, if desired, golfers who played the same course but at different times could "replay" their rounds together in a virtual computer world.

As yet additional potential features, if desired, systems and methods according to examples of this invention could be set up to automatically post the golfer's score to the appropriate system for maintaining their handicap. Optionally, if desired, systems and methods according to examples of this invention could allow the user an opportunity to review the automatically maintained scoring to assure that it is correct (e.g., to assure that no strokes were missing from the score, to assure that no practice swings or other incidents were misinterpreted as shots, to assure that any necessary penalty strokes were added to the score due to shots going out of bounds or into hazards, etc.).

As another feature, if desired, systems and methods according to at least some examples of this invention may indicate to the user when it receives some "problematic data" and ask for clarification. This request for clarification could occur at any time, including contemporaneously with receipt of the data (e.g., out on the golf course), during downloading of the data, prior to posting the scores for handicap purposes, during data analysis, etc. Any number of reasons could result in the generation of "problematic data" of this type. For example, after making a bad swing or shot, a golfer will often take a second shot from the same location (e.g., for practice, as a "mulligan," etc.). As another example, a golfer might hit acorns, walnuts, range balls, or other things (including the ground itself, e.g., in a practice swing). As yet another example, another player will occasionally ask to hit a golfer's club, and such swings also should not be counted in the golfer's score. In such situations where "problematic data" is generated, systems and methods according to at least some examples of this invention may query the golfer as to which shot(s) should be counted and recorded.

Finally, if desired, at least some of the features of this invention, such as the tracking system, the coordinating system, the recording system, and/or the displaying system, may be housed in an electronic device carried by the user, including conventional electronic devices, such as cellular telephones, pagers, MP3 (or other portable audio/video devices), and the like. If necessary, such conventional devices may be modified to include software and/or equipped with an input module to enable it to receive such data. If desired, data could be transmitted from the golf club or other devices to one of these conventional portable electronic devices (or a specially designed device, if desired) in a manner akin to the manner in which the NIKE+ system (available from NIKE Inc. of Beaverton, Oreg.) operates (e.g., in the manner in which the NIKE+ sensor mounted in the shoe transmits data to the NIKE+ input module attached to a conventional audio/video display device for display, storage, analysis, further processing, to provide feedback, etc.) and in the same manner in which the NIKE+ system allows this collected data to be downloaded to a user's personal computer and/or to a website via a networked connection.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1 through 12 may be used individually and/or in any combination or subcombination without departing from this invention.

I claim:

1. A system for tracking a round of golf comprising:

a tracking system to track a golfer's position on a golf course;

a golf stroke information providing system for providing information about a golf stroke taken by the golfer, wherein the information about the golf stroke taken includes at least information indicating that a stroke was taken and a golf club used to make the stroke;

a recording system to record and store information about the golf stroke taken and information about the golfer's tracked position on the golf course;

a coordinating system to coordinate the information about the golf stroke taken with the information about the golfer's tracked position on the golf course;

a displaying system that allows a golfer to view the information recorded by the recording system; and a transmitting system that transmits the information about the golf stroke taken and the information about the golfer's tracked position on the golf course to a receiver, wherein the transmitting system is selectively activated by removing the golf club from a golf bag.

2. The system for tracking a round of golf according to claim 1, wherein the tracking system includes a global positioning device for determining the golfer's position on the golf course and the global positioning device is engaged with a golf club.

3. The system for tracking a round of golf according to claim 1, wherein the tracking system includes a global positioning device for determining the golfer's position on the golf course and the global positioning device is engaged with an article of footwear worn by the golfer.

4. The system for tracking a round of golf according to claim 1, wherein the golf stroke information providing system is engaged with a golf club and the information about the golf stroke taken is transmitted to the coordination system to be coordinated with the tracked position of the golfer on the golf course; and wherein the tracking system includes a global positioning device within a portable device that may be transported around the golf course by the golfer.

5. The system for tracking a round of golf according to claim 1, wherein the golf stroke information providing system is engaged with a golf club and provides information on one or more characteristics of the golf stroke in addition to the indication that the golf stroke has been taken.

6. The system for tracking a round of golf according to claim 5, wherein the golf stroke information providing system includes an impact sensor engaged with a head of the golf club.

7. The system for tracking a round of golf according to claim 6, wherein the impact sensor provides information on at least one member selected from the group of: a portion of the club head that contacted the golf ball or a force generated by the impact of the golf club with a golf ball.

8. The system for tracking a round of golf according to claim 1, wherein one or more of the golf stroke information providing system or the tracking system is selectively activated by the golfer grasping a handle of the golf club.

9. The system for tracking a round of golf according to claim 1, wherein the transmitting system transmits the information about the golf stroke taken without need for a manual indication from the golfer.

10. The system for tracking a round of golf according to claim 1, wherein the displaying system includes a portable display device to which the recorded information is transmitted so that the recorded information about the round of golf can be viewed by the golfer while on the golf course during the round of golf.

11. The system for tracking a round of golf according to claim 1, wherein the displaying system can display the round of the golf in either a visualization mode in which the round is played back stroke by stroke or in an overview mode in which the recorded information is superimposed on images of the golf course or a portion of the golf course; and wherein the displaying system uses at least one of satellite images or computer-generated images of the golf course or a portion of the golf course.

12. A method of producing a system for tracking a round of golf comprising:

providing a tracking system to track a golfer's position on a golf course;

providing a golf stroke information providing system for providing information about a golf stroke taken by the golfer, wherein the information about the golf stroke taken includes at least information indicating that a stroke was taken and a golf club used to take the stroke;

providing a recording system to record and store the information about the golf stroke taken and information about the golfer's tracked position on the golf course;

providing a coordinating system to coordinate the information about the golf stroke taken with the information about the golfer's tracked position on the golf course;

providing a displaying system that allows a golfer to view the information recorded by the recording system;

configuring the tracking system to receive information about the golf stroke taken from the golf stroke information providing system; and providing a transmitting system that transmits the information about a golf stroke taken and the information about the golfer's tracked position on the golf course, wherein the transmitting system is selectively activated by removing the golf club from a golf bag.

13. A method according to claim 12, wherein the step of providing the tracking system further includes providing a global positioning device for determining the golfer's position on the golf course, wherein the global positioning device is engaged with a golf club.

14. A method according to claim 12, wherein the step of providing the tracking system further includes providing a global positioning device for determining the golfer's position on the golf course, wherein the global positioning device is engaged with an article of footwear worn by the golfer.

15. A method according to claim 12, wherein the step of providing the golf stroke information providing system includes providing the golf stroke information providing system engaged with a golf club, wherein the golf stroke information providing system provides information on one or more characteristics of the golf stroke in addition to the indication that the golf stroke has been taken.

16. A method according to claim 15, wherein the golf stroke information providing system includes an impact sensor engaged with a head of the golf club.

17. A method according to claim 16, wherein the impact sensor provides information on at least one member selected from the group of: a portion of the club head that contacted the golf ball or a force generated by the impact of the golf club with a golf ball.

18. A method according to claim 12, further comprising:

providing a switch for selectively activating one or more of the golf stroke information providing system or the tracking system, wherein the switch is provided in a handle of a golf club and is activated by the golfer grasping the handle of a golf club.

19. A method according to claim 12, wherein the transmitting system transmits the information about the golf stroke taken without need for a manual indication from the golfer.

20. A system for tracking a round of golf comprising:

a tracking system to track a golfer's position on a golf course wherein the tracking system includes a global positioning device attached with a golf club to track the golfer's position on the golf course, a golf stroke sensor engaged with the golf club to determine information about a golf stroke taken by the golfer;

a coordinating system to coordinate the information from the golf stroke sensor with the information from the global positioning device;

a transmitting system to transmit the information from the golf stroke sensor and the information from the global positioning device to a receiver, wherein the transmitting system transmits the information about the golf stroke taken without need for a manual indication from the golfer;

a receiver including a recording system to record and store the information received from the transmitter; and a displaying system that allows a golfer to view the information recorded by the recording system.

21. A system for tracking a round of golf according to claim 20, wherein the displaying system is portable and carriable by a golfer while on the golf course during the round of golf.

22. A system for tracking a round of golf according to claim 20, wherein the information determined by the golf stroke sensor includes at least an indication that a golf ball was struck by the club and an identifier of the club used to strike the golf ball.

23. A method for tracking a round of golf comprising:

tracking a golfer's position on a golf course using a global positioning device attached with a golf club;

generating golf stroke data indicating information about a golf stroke taken by the golfer, wherein the information about the golf stroke taken includes at least information indicating that a stroke was taken and a golf club used to make the stroke, and wherein the transmitting about the golf stroke taken is transmitted to a receiver without need for a manual indication from the golfer;

correlating information about the golf stroke taken with the golfer's position on the golf course when the golf stroke was taken;

storing the information about the golf stroke taken and the golfer's tracked position on the golf course; and displaying information about the golf round to the golfer based on the information about the golf stroke taken and the golfer's tracked position on the golf course.

24. A system for tracking a round of golf, comprising:

a golf club including a stroke sensor and a transmission system for wirelessly transmitting information about a golf stroke taken by a golfer including information identifying a club used for the golf stroke and information that a golf stroke was taken, wherein the transmission system transmits the information about the golf stroke taken without need for a manual indication from the golfer;

a receiver for receiving the transmitted information;

a tracking system to track the golfer's position on a golf course;

a coordinating system to coordinate the information about the golf stroke taken with information about the golfer's tracked position on the golf course; and a recording system to record and store information about the golf stroke taken and information about the golfer's tracked position on the golf course, wherein the stroke sensor includes a motion sensor configured to determine that a golf stroke has been taken, wherein the motion sensor includes a gyroscope.

25. A system according to claim 24, wherein at least the tracking system and the recording system are included within a single device that is separate from the golf club.

26. A system according to claim 25, wherein the single device is portable and carriable by a golfer during a round of golf.

27. A system according to claim 25, wherein the single device further includes a displaying system that allows a golfer to view the information recorded by the recording system.

28. A system according to claim 25, wherein the single device includes an output system that allows the information recorded by the recording system to be downloaded to an external device.

29. A system according to claim 28, wherein the external device is a personal computer.

30. A system according to claim 28, wherein the output system includes wireless transmission capability.

31. A system according to claim 28, wherein the output system includes a port for connecting to an output cable or wire.

32. A system according to claim 24, further comprising:

a display system for displaying information recorded by the recording system.

33. A system according to claim 32, wherein the display system displays information relating to at least a portion of a round of golf provided along with a visual representation of at least a portion of the golf course on which the round of golf was played.

34. A system according to claim 32, wherein the visual representation includes at least one member selected from the group of: satellite imagery of the golf course or a portion thereof, a computer-generated animation of the golf course or a portion thereof, and photographs of the golf course or a portion thereof.

35. A system according to claim 32, wherein the display system allows the round of golf or at least a portion thereof to be played back in an animated manner.

36. A system according to claim 35, wherein the animated manner plays back at least some of the golf strokes taken during the round of golf in a stroke-by-stroke manner.

37. A system according to claim 32, wherein the display system included as part of a personal computer.

38. A system according to claim 24, wherein the tracking system utilizes global positioning satellite data.

* * * * *